US010829840B2

(12) United States Patent
Murakami et al.

(10) Patent No.: US 10,829,840 B2
(45) Date of Patent: Nov. 10, 2020

(54) STEEL SHEET FOR HOT PRESSING AND HOT PRESSED ARTICLE USING THE SAME

(71) Applicant: voestalpine Stahl GmbH, Linz (AT)

(72) Inventors: Toshio Murakami, Kobe (JP); Junya Naitou, Kobe (JP); Keisuke Okita, Kobe (JP); Shushi Ikeda, Kobe (JP); Shinji Sato, Kobe (JP); Andreas Pichler, Vöcklabruck (AT); Thomas Kurz, Linz (AT)

(73) Assignees: voestalpine Stahl GmbH, Linz (AT); Kobe Steel, Ltd., Hyogo (JP)

( * ) Notice: Subject to any disclaimer, the term of this patent is extended or adjusted under 35 U.S.C. 154(b) by 57 days.

(21) Appl. No.: 15/550,355

(22) PCT Filed: Dec. 10, 2015

(86) PCT No.: PCT/JP2015/084691
§ 371 (c)(1),
(2) Date: Aug. 10, 2017

(87) PCT Pub. No.: WO2016/093316
PCT Pub. Date: Jun. 16, 2016

(65) Prior Publication Data

US 2019/0010587 A1 Jan. 10, 2019

(30) Foreign Application Priority Data

Dec. 10, 2014 (JP) ..... 2014-250055

(51) Int. Cl.
*C22C 38/32* (2006.01)
*C21D 9/46* (2006.01)
(Continued)

(52) U.S. Cl.
CPC ..... *C22C 38/32* (2013.01); *C21D 8/0226* (2013.01); *C21D 8/0278* (2013.01); *C21D 9/00* (2013.01);
(Continued)

(58) Field of Classification Search
None
See application file for complete search history.

(56) References Cited

U.S. PATENT DOCUMENTS 6,203,630 B1 * 3/2001 Matsumura ..... C22C 38/04 148/330
2011/0091348 A1 * 4/2011 Hatano ..... C21D 6/005 420/83

FOREIGN PATENT DOCUMENTS

JP 2003147499 A 5/2003
JP 2006009116 A 1/2006
(Continued)

OTHER PUBLICATIONS

Machine Translation of JP2010174281 (Year: 2017).*

*Primary Examiner* — Coris Fung
*Assistant Examiner* — Christopher D. Moody

(57) ABSTRACT

A steel sheet for hot pressing includes in a chemical composition, in percent by mass, C of 0.1% to 0.4%, Si of greater than 0% to 2.0%, Mn of 0.5% to 3.0%, P of greater than 0% to 0.015%, S of greater than 0% to 0.01%, B of 0.0003% to 0.01%, N of greater than 0% to 0.05%, Al in a content of 2×[N]% to 0.3% at a Si content of greater than 0.5% to 2.0%; or Al in a content of (0.20+2×[N]−0.40×[Si]N)% to 0.3% at a Si content of 0% to 0.5%, where [N] and [Si] are contents of N and Si, respectively, in mass percent, with the remainder being iron and inevitable impurities, where contents of Ti, Zr, Hf, and Ta, of the inevitable impurities, are each controlled to 0.005% or lower. The steel sheet includes
(Continued)

nitride-based inclusions with an equivalent circle diameter of 1 μm or more in a number density of 0.10 per square millimeter.

1 Claim, 1 Drawing Sheet

(51) Int. Cl.

| | |
|---|---|
| ***C22C 38/06*** | (2006.01) |
| ***C22C 38/58*** | (2006.01) |
| ***C21D 9/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/28*** | (2006.01) |
| ***C21D 1/18*** | (2006.01) |

(52) U.S. Cl.

CPC ..... *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/28* (2013.01); *C22C 38/58* (2013.01); *C21D 1/18* (2013.01); *C21D 8/02* (2013.01)

(56) References Cited

FOREIGN PATENT DOCUMENTS

| | | | | | |
|---|---|---|---|---|---|
| JP | 2006070346 | A | | 3/2006 | |
| JP | 2010047786 | A | | 3/2010 | |
| JP | 2010150612 | A | | 7/2010 | |
| JP | 2010174280 | A | | 8/2010 | |
| JP | 2010174281 | A | * | 8/2010 | ..... C22C 38/00 |
| JP | 2010174281 | A | | 8/2010 | |

* cited by examiner

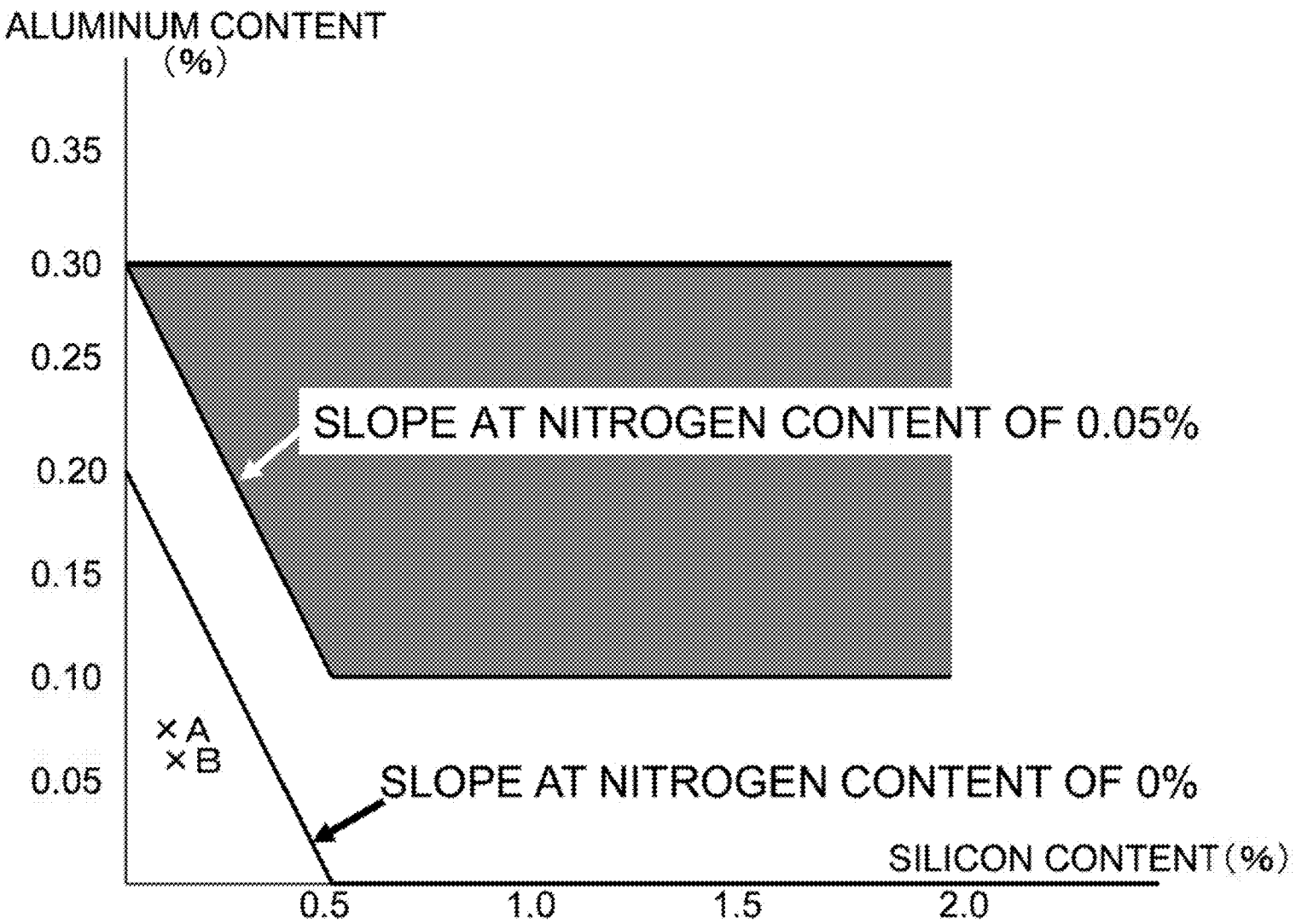
ALUMINUM CONTENT (%)
0.35
0.30
0.25
0.20
0.15
0.10
0.05
SLOPE AT NITROGEN CONTENT OF 0.05%
SLOPE AT NITROGEN CONTENT OF 0%
× A
× B
0.5
1.0
1.5
2.0
SILICON CONTENT (%)

STEEL SHEET FOR HOT PRESSING AND HOT PRESSED ARTICLE USING THE SAME

FIELD OF THE INVENTION

The present invention generally relates to steel sheets for hot pressing, and hot pressed articles using the steel sheet. The steel sheets for hot pressing will be described hereinafter mainly on automobile-use steel sheets as typical examples thereof, which are, however, never intended to limit the scope of the present invention.

BACKGROUND OF THE INVENTION

Demands have been recently made to provide steel sheets to have higher strengths so as to provide automobiles and other products with better fuel efficiency. Typically, high-tensile strength steels having a tensile strength of 600 MPa or more even when having a thickness of about 1.0 mm to 20 mm allow the automobiles to have lighter both body weights and to offer collision stability and are generally used. For further higher body strengths upon side-impact collision, use of ultrahigh-tensile strength steels having a tensile strength on the orders of 1000 MPa and 1500 MPa has been investigated recently. The ultrahigh-tensile strength steels, however, disadvantageously have inferior workability due to their extremely high strengths.

Independently, hot pressing has received attention as a technique of providing high-strength processed articles having a tensile strength on the order of 1000 MPa without the use of ultrahigh-tensile strength steels. The hot pressing is a technique of heating a blank steel sheet to a temperature in the austenite region, whereby softening the steel sheet, and rapidly cooling the steel sheet for quenching while processing the steel sheet with a tool. This gives a hot pressed article as a processed article having a high strength and excellent shape fixability. The hot pressing is also called, for example, hot stamping or die quenching.

Conventional steel sheets for hot pressing have been designed to ensure hardenability by solute boron and to have higher strengths by the addition of Ti and B. The resulting processed articles formed by hot pressing of the steel sheets, however, can suffer from cracking upon collision. To solve this, demands have been made to provide a steel sheet for hot pressing which can ensure hardenability at certain level and can prevent cracking (breakage) upon collision.

Patent literature (PTL) 1 to 4 disclose techniques relating to steel sheets for hot pressing added with not Ti but B, although these techniques are not intended to prevent cracking upon collision. Titanium (Ti) element, however, fixes nitrogen (N) as titanium nitride (TiN), thereby prevents the added boron from forming boron nitride (BN), and helps the steel sheet to ensure hardenability by solute boron, where the nitrogen inhibits the formation of solute boron. A steel, if not added with Ti, may therefore hardly ensure hardenability at certain level.

CITATION LIST

Patent literature

[Patent Literature 1] Japanese Unexamined Patent Application Publication (JP-A) No. 2003-147499

[Patent Literature 2] JP-A No. 2006-9116

[Patent Literature 3] JP-A No. 2006-70346

[Patent Literature 4] JP-A No. 2010-174280

SUMMARY OF THE INVENTION

Problem to be Solved by the Invention

The present invention has been made while focusing attention on the circumstances, and an object thereof is to provide a steel sheet for hot pressing which effectively ensures better hardenability by boron addition without titanium addition as in the conventional technologies and can still offer better bendability after processing; and a hot pressed article manufactured from the steel sheet for hot pressing.

Means for Solving the Problem

The present invention has achieved the object and provides a steel sheet for hot pressing. The steel sheet includes, in a chemical composition: C in a content of 0.1% to 0.4%; Si in a content of 0% to 2.0%; Mn in a content of 0.5% to 3.0%; P in a content of greater than 0% to 0.015%; S in a content of greater than 0% to 0.01%; B in a content of 0.0003% to 0.01%; N in a content of greater than 0% to 0.05%; and Al in a content of 2×[N]N to 0.3% at a Si content of greater than 0.5% to 2.0%; or Al in a content of (0.20+2×[N]−0.40×[Si])% to 0.3% at a Si content of 0% to 0.5%, where [N] and [Si] are contents of N and Si, respectively, in mass percent, with the remainder being iron and inevitable impurities, in which the steel sheet has contents of Ti, Zr, Hf, and Ta, of the inevitable impurities, controlled to 0.005% or lower, and the steel sheet includes nitride-based inclusions with an equivalent circle diameter of 1 μm or more in a number density of less than 0.10 per square millimeter.

In a preferred embodiment of the present invention, the steel sheet for hot pressing may further include at least one element selected from the group consisting of: Cr in a content of greater than 0% to 0.5%; Mo in a content of greater than 0% to 0.5%; Cu in a content of greater than 0% to 0.5%; and Ni in a content of greater than 0% to 0.5%

In another preferred embodiment of the present invention, the steel sheet for hot pressing may further include at least one element selected from the group consisting of: V in a content of greater than 0% to 0.2%; and Nb in content of greater than 0% to 0.2%.

In addition and advantageously, the present invention provides a hot pressed article to achieve the object. The hot pressed article has any one of the chemical compositions as defined above, includes martensite in an area percentage of 90% or higher of its entire microstructure, and has a number density of nitride-based inclusions with an equivalent circle diameter of 1 μm or more of less than 0.10 per square millimeter.

Effects of the Invention

The present invention employs a steel sheet for hot pressing which has appropriately controlled contents of its chemical composition, Al, Si, B, and nitride-based-inclusion-forming elements and has a controlled (reduced) number density of coarse nitride-based inclusions. The use of the steel sheet for hot pressing can provide a hot pressed article that ensures hardenability upon processing even without the addition of Ti and still has a high strength and excellent bendability.

BRIEF DESCRIPTION OF THE DRAWINGS

FIG. 1 is a diagram schematically illustrating the relationship between the Si content and the Al content in steel sheets for hot pressing according to embodiments of the present invention.

DETAILED DESCRIPTION OF THE PREFERRED EMBODIMENTS

To provide a steel sheet for hot pressing having a high strength and being highly stable upon collision, the inventors made investigations based on boron-added steel sheets that can have better hardenability by solute boron. Improvements in bendability are known to be effective for preventing cracking upon collision. Based on this knowledge, the inventors investigated influencing factors on bendability, and found that TiN and other nitride-based inclusions act as fracture origins during deformation; and that the addition of Ti to a steel causes the steel to have inferior bendability.

However, Ti element prevents added boron from forming boron nitride (BN) and importantly contributes to hardenability by solute boron; and a steel, if not added with Ti, may therefore hardly ensure certain hardenability, as described above.

The inventors therefore conceived the use of Al as an alternative element to Ti so as to ensure hardenability by solute boron even without Ti addition. Al is a nitride-forming element as with Ti and can fix nitrogen as aluminum nitride (AlN), where nitrogen impedes the formation of solute boron. Increase in Al activity so as to form AlN helps the steel sheet to ensure hardenability by solute boron at certain level.

In addition, the inventors focused attention on Si so as to increase the Al activity and to stabilize AlN, because the Si element impedes the formation of BN and stabilizes AlN. To increase the Al activity and to allow Si to effectively exhibit the actions, the Al and Si contents may be increased. Disadvantageously, this invites deterioration typically in economic efficiency and weldability, as described later. Al may be contained in a minimum necessary amount to fix nitrogen from the viewpoint of allowing Al to fix nitrogen and to form AlN. The Al activity can be increased to ensure predetermined hardenability at a higher Si content even at a lower Al content. For these reasons, the necessary Al content is specified in the present invention so as to meet conditions specified by (1) and (2) as follows:

(1) Al is contained in a content of (2×[N]% to 0.3% at a Si content of greater than 0.5% to 2.0%; and (2) Al is contained in a content of (0.20+2×[N]−0.40×[Si])% to 0.3% at a Si content of 0% to 0.5%.

In the Al content as specified by the conditions (1) and (2), the lower limit of the Al content is specified in relation to the nitrogen content as (2×[N]), where [N] represents the content of nitrogen. This is because of controlling the atomic ratio between Al and N so as to allow Al to be combined with nitrogen and to fix nitrogen as AlN.

The relationship between Al and Si contents will be illustrated in more detail with reference to FIG. 1. FIG. 1 is plotted with the abscissa indicating the Si content (in mass percent) and the ordinate indicating the Al content (in mass percent), in which the diagonally shaded area schematically illustrates the range of the Al and Si contents specified in the present invention. In FIG. 1, the nitrogen content is set to 0.05% as the upper limit of the range specified in the present invention, so as to approximately define or specify the Al and Si contents. In FIG. 1, the symbols ×A and ×B fall within range of conventional examples (comparative examples) and correspond to Steels A and B in Table 1 mentioned later.

Such conventional steel sheets for hot pressing have low Al and Si contents and contain Al in a content of about 0.03% to about 0.04% and Si in a content of about 0.2%, as indicated by the symbols ×A and ×B in FIG. 1. These steel sheets, when hot pressed, are found to have inferior bendability as indicated as Test Nos. 1 and 2 in Table 2 mentioned later.

In contrast, the Al and Si contents are herein set higher than those of the conventional examples as illustrated in FIG. 1, so as to offer higher Al activity. It should be noted, however, that the contents of the two elements are not increased equally. Al is added in a decreasing Al content according to the Si content at a low Si content of 0.5% or lower as specified by the condition (2); whereas Al is added in a content of at least ([N]×2) or more at a high Si content of 0.5% or higher as specified by the condition (1) so that the added Al fixes nitrogen to form AlN.

In addition, the steel sheet according to the present invention is adapted to have a lower number density of coarse nitride-based inclusions such as TiN so as to ensure both hardenability and bendability. The steel sheet according to the present invention is not positively added with Ti, but includes at an inevitable impurity level so as to ensure good bendability, as described above. Even when not added positively, however, Ti may be incorporated inevitably as an impurity into the steel typically from an iron source for the steel. The impurity Ti may be combined with solute nitrogen in the steel during steel casting to form coarse TiN that acts as a fracture origin upon deformation. The coarse nitride-based inclusions can be refined by appropriately controlling the average cooling rate before and after steel solidification, as described later.

Titanium (Ti) is taken as a representative example of the nitride-based-inclusion-forming elements in the above description, but Zr, Hf, and Ta elements behave in the same manner as with Ti. These elements are contained as inevitable impurities. The contents of the nitride-based-inclusion-forming elements are herein controlled to be 0.005% or lower so as to allow the steel sheet to surely exhibit good bendability.

The present invention has been made based on these findings and viewpoints. Specifically, the steel sheet for hot pressing according to the present invention includes, in a chemical composition, C in a content of 0.1% to 0.4%; Si in a content of 0% to 2.0%; Mn in a content of 0.5% to 3.0%; P in a content of greater than 0% to 0.015%; S in a content of greater than 0% to 0.01%; B in a content of 0.0003% to 0.01%; N in a content of water than 0% to 0.05%; and Al in a content of 2×[N]% to 0.3% at a Si content of greater than 0.5% to 2.0%; or Al in a content of (0.20+2×[N]−0.40×[Si])% to 0.3% at a Si content of 0% to 0.5%, where [N] and [Si] are contents of N and Si, respectively, in mass percent, with the remainder being iron and inevitable impurities; the steel sheet has contents of Ti, Zr, Hf, and Ta, of the inevitable impurities, of each controlled to 0.005% or lower, and the steel sheet includes nitride-based inclusions with an equivalent circle diameter of 1 μm or more in a number density of less than 0.10 per square millimeter.

Initially, the chemical composition of the steel sheet for hot pressing according to the present invention will be described in detail. All contents of elements are indicated in mass percent.

C of 0.1% to 0.4%

Carbon (C) element is essential for ensuring a satisfactory strength upon quenching in hot pressing and is particularly essential for forming martensite to help the hot pressed article to have a higher strength. To exhibit such actions effectively, the carbon content may be 0.1% or higher in terms of lower limit. However, carbon, if contained in excess, may cause the steel sheet to have a strength higher than necessary to thereby be inferior not only in hot workability, but also in other properties such as weldability. To prevent this, the carbon content is controlled to 0.4% or lower in terms of upper limit.

The preferred range of the carbon content may vary depending on the preferred tensile strength of the hot pressed article after processing. For example, the carbon content is preferably from 0.12% to 0.17% to ensure a strength on the order of 1180 MPa (specifically, from 1180 MPa to less than 1470 MPa); is preferably from 0.17% to 0.24% to ensure a strength on the order of 1470 MPa (specifically, from 1470 MPa to less than 1760 MPa); and is preferably from 0.28% to 0.35% to ensure a strength on the order of 1760 MPa (specifically, from 1760 MPa to less than 1960 MPa).

Si of 0% to 2.0%

Silicon (Si) element has high solid-solution strengthening ability, increases the Al activity to stabilize AlN, impedes the formation of BN, and effectively ensures hardenability. For exhibiting such actions effectively, it is effective to increase the Si content as much as possible. However, this is not necessary at a high Al content, as demonstrated by the results of experiments by the inventors. Accordingly, the steel sheet can ensure desired hardenability even not added with Ti when the lower limit of the Al content is set according to the Si content, as will be illustrated in the description for Al. The Si content is preferably 0.1% or higher, and more preferably 0.2% or higher in terms of lower limit. However, Si, if contained in an excessively high content, may cause significant scale formation during hot rolling. To prevent this, the Si content is controlled to 2.0% or lower, preferably 1.8% or lower, and more preferably 1.5% or lower, in terms of upper limit.

Mn of 0.5% to 3.0%

Manganese (Mn) element is useful for better hardenability. To exhibit such actions effectively, the Mn content may be 0.5% or higher and preferably 0.7% or higher in terms of lower limit. However, Mn, if present in excess, may exhibit saturated effects and cause economical waste. To prevent this, the Mn content is controlled to 3.0% or lower, and preferably 2.5% or lower, in terms of upper limit.

P of Greater than 0% to 0.015%

Phosphorus (P) element is inevitably present in the steel as an impurity, segregates along prior austenite gain boundaries, and thereby causes the steel sheet to have inferior ductility/toughness. To prevent this, the phosphorus content is controlled to 0.015% or lower and is preferably 0.01% or lower, in terms of upper limit. The phosphorus content is preferably minimized, but it is practically difficult to reduce the same to 0%. In addition, an excessive dephosphorization treatment may invite higher cost. To prevent this, the phosphorus content is preferably 0.001% or higher in terms of lower limit.

S of Greater than 0% to 0.01%

Sulfur (S) element is also inevitably present as an impurity, forms sulfide inclusions, and thereby adversely affects the bendability. To prevent this, the sulfur content is controlled to 0.01% or lower and is preferably 0.003% or lower, in terms of upper limit. The sulfur content is preferably minimized, but it is practically difficult to reduce the same to 0%. In addition, an excessive desulfurization treatment may cause higher cost. To prevent this, the sulfur content is preferably 0.0005% or higher in terms of lower limit.

B of 0.0003% to 0.01%

Boron (B) element effectively contributes to better hardenability. To exhibit such actions, the boron content may be 0.0003% or higher and preferably 0.0005% or higher in terms of lower limit. However, boron, if contained in excess, may exhibit saturated actions and may cause hot crack contrarily. To prevent this, the boron content is controlled to 0.01% or lower, preferably 0.005% or lower, and more preferably 0.004% or lower, in terms of upper limit.

N of Greater than 0% to 0.05%

Nitrogen (N) element is inevitably present, forms TiN to adversely affect the bendability, and forms BN to reduce solute boron and to adversely affect the hardenability and weldability. To prevent this, the nitrogen content is preferably minimized and is controlled to 0.05% or lower, and preferably 0.01% or lower in terms of upper limit. The nitrogen content is preferably minimized, but it is practically difficult to reduce the same to 0%. In addition, an excessive denitrification treatment may invite increased cost. To prevent this, the nitrogen content is preferably 0.001% or higher in terms of lower limit.

Al as Specified by the Conditions (1) and (2)

Aluminum (Al) element is added as a deoxidizer, offers an increasing activity to form AlN more readily at a higher content thereof, and contributes to ensuring of solute boron. To exhibit such actions effectively, the lower limit of the Al content may be increased. However, even at a low Al content, Al can offer higher activity to ensure predetermined hardenability when the Si content is increased, as long as Al is contained in a minimum necessary amount for fixing nitrogen as AlN. For this mason, the necessary Al content is varied herein depending on the Si content. The lower limit of the Al content is specified herein as 2×[N] in relation to the nitrogen content. This is for setting the atomic ratio of Al to N to 1:1 so as, to fix Al as AlN.

Preferred lower limits of the Al content as specified by the conditions (1) and (2) are as follows:

(1) the Al content is preferably (2×[N]+0.005)% or higher, and more preferably (2×[N]+0.01)% or higher at a Si content of greater than 0.5% to 2.0%; and (2) the Al content is preferably (0.205+(2×[N])−0.40×[Si]) % or higher, and more preferably (0.21+(2×[N])−40×[Si] or more at a Si content of 0% to 0.5%.

The upper limit of the Al content is 0.3% in both the conditions (1) and (2). This is because Al, if added in excess, may exhibit saturated actions and cause economical waste. The Al content is preferably 0.28% or lower, and more preferably 0.25% or lower in terms of upper limit.

The steel sheet for hot pressing according to the present invention basically contains the above elements, with the remainder being iron and it impurities.

Of inevitable impurity elements, the contents of Ti, Zr, Hf, and Ta are each controlled to 0.005% or lower in terms of upper limit. This is because these elements are nitride-forming elements and form coarse nitride-based inclusions acting as fracture origins. The contents of the elements are preferably minimized and are preferably each 0.003% or lower.

The steel sheet for hot pressing according to the present invention may further selectively contain any of acceptable elements as follows, within ranges not adversely affecting the operation of the present invention.

At least one element selected from the group consisting of: Cr of greater than 0% to 0.5%; Mo of greater than 0% to 0.5%; Cu of greater than 0% to 0.5%; and Ni of greater than 0% to 0.5%.

These elements are effective for better hardenability. Each of the elements may be added alone or in combination. To exhibit the actions effectively, the toad content of the elements is preferably 0.1% or higher in terms of lower limit. The term "total content" refers to the amount of a single element upon single addition or to the total amount of two or more elements upon combination addition. In view of the actions alone, the more the contents of the respective elements, the better. However, the elements, if added in excess, may exhibit saturated effects and cause economical waste. To prevent this, the contents of the elements are each preferably 0.5% or lower in terms of upper limit.

At least one element selected from the group consisting of: V of greater than 0% to 0.2%; and Nb of greater than 0% to 0.2%

Vanadium (V) and niobium (Nb) elements contribute to refinement of austenite grains and effectively offer a higher strength. To exhibit such actions effectively, the total content of the elements is preferably 0.02% or higher in terms of lower limit. The term "total content" herein refers to the amount of a single element upon single addition or the total amount of the two elements upon combination addition. However, the elements, if added in excess, may exhibit saturated effects and cause economical waste. To prevent this, the total content of the elements is preferably 0.2% or lower in terms of upper limit.

Next, the microstructure featuring the steel sheet for hot pressing according to the present invention will be illustrated.

The steel sheet according to the present invention is adapted to have a number density of nitride-based inclusions with an equivalent circle diameter of 1 μm or more of less than 0.10 per square millimeter, as described above. This reduces coarse nitride-based inclusions acting as fracture origins and contributes to better bendability. As used herein the term "nitride-based inclusions" refers to nitrides typically of Al, B, Ti, Zr, Hf, and Ta which precipitate in the steel microstructure. The nitride-based inclusions to be controlled herein are those with an equivalent circle diameter of 1 μm or more. This is because the experimental results made by the inventors demonstrate that the nitride-based inclusions of the size closely or significantly contribute to inferior bendability. To ensure good bendability, the number density of the coarse nitride-based inclusions is preferably minimized, and is preferably less than 0.05.

The present invention specifically controls the number density of the coarse nitride-based inclusions. The number density of other fine nitride-based inclusions with an equivalent circle diameter of less than 1 μm is not critical. The steel sheet, when manufactured by a method recommended herein, may include the fine nitride-based inclusions in a number density of about 2 to about 100 per square millimeter.

An exemplary measuring method for the size and number density of nitride-based inclusions will be illustrated below.

The size and number density of nitride-based inclusions can be measured by cutting out a test specimen from the steel sheet at a position one-fourth deep the thickness of the steel sheet (t/4; where t is the sheet thickness); and observing a cross section of the test specimen parallel to the rolling direction and to the thickness direction with a field emission-scanning electron microscope (FE-SEM). In an experimental example mentioned later, SUPRA 35 supplied by Carl Zeiss AG was used as the FE-SEM.

Specifically, while setting an observation magnification of the FE-SEM at 400 folds, hundred (100) or more view fields each having an area of 0.375 $mm^2$ are randomly selected and observed. Chemical compositions (in mass percent) of central parts of inclusion particles with an equivalent circle diameter of 1 μm or more observed in each view field are determined by semi-quantitative analysis in the following manner, The analysis employs an energy dispersive X-ray spectrometer (EDX) attached to the FE-SEM. Initially, on an inclusion particle containing nitrogen, the total content "A" of Al, B, Ti, Zr, Hf, and Ta as the nitride-based-inclusion-forming elements is calculated. Hereinafter the elements Al, B, Ti, Zr, Hf, and Ta are also referred to as "Ti and the similar elements". Likewise, the total content "B" of elements such as Mn, Si, S, and Cr contained in the inclusion particle, except Fe and O, is calculated. A standardized value is calculated by dividing the total content "A" by the total content "B". Inclusion particles having a standardized value of 50% or higher are herein defined as nitride-based inclusions and are counted to give a number. The number of the observed nitride-based inclusions is divided by the observation area of 0.375 $mm^2$to give a number density per square millimeter. The procedure is repeated in the all view fields, and the average of the number densities is defined as the number density of nitride-based inclusions with an equivalent circle diameter of 1 μm or more.

Iron (Fe) and oxygen (O) are excluded from the elements as the denominators in the standardization of the total content "A" of Ti and the similar elements. This is because as follows. Iron is excluded so as to eliminate the influence of Fe contained in the matrix iron on the measurement result. Oxygen is excluded so as to determine whether an inclusion to be analyzed is a nitride of the target Ti and the similar elements. Specifically, the nitride-based-inclusion-forming elements Al, B, Ti, Zr, Hf, and Ta have oxide-forming ability equal to or lower than those of rare-earth metals (REMs) and other oxide-based-inclusion-forming elements and may probably fail to form oxides mainly including Ti and the similar elements. Based on this consideration, inclusions having a total content of Ti and the similar elements of more than 50% based on the total content of elements except oxygen (and iron) are determined as nitrides of Ti and the similar elements.

The steel sheet for hot pressing according to the present invention may have a surface in any form and includes both not-coated sheets such as hot-rolled sheets and cold-rolled sheets each having no coating on the surface; and coated sheets including hot-rolled sheets and cold-rolled sheet each having a coating on the surface.

The steel sheet for hot pressing according to the present invention has been described above.

Next, a preferred method for manufacturing the steel sheet for hot pressing will be illustrated.

Initially, raw materials for steel are blended and subjected to ingot-making in a converter to yield a steel having a chemical composition controlled within the range specified in the present invention. Materials having contents of nitride-based-inclusion-forming elements such as Ti as low as possible may be selected as the raw materials.

The ingot steel made in the above manner is formed into a slab by continuous casting. For a lower number density of coarse nitride-based inclusions, it is recommended to perform cooling by die cooling at an average cooling rate higher than that in a common procedure (about 0.2° C./s) in the temperature range in the vicinity of steel solidification of 1500° C. to 1300° C. The average cooling rate is preferably 0.5° C./s or more, and more preferably 0.8° C./s or more. The average cooling rate employed herein is determined by measuring the surface temperature of the steel sheet; and calculating an average cooling rate at a position one-fourth the thickness D of the steel sheet by heat transfer calculation.

The resulting slab is hot-rolled at a heating temperature of 1100° C. to 1300° C. and a finish rolling temperature of 800° C. to 1200° C., coiled at a temperature of 300° C. to 700° C., and yields a hot-rolled sheet. The hot-rolled sheet may be used herein as intact as a steel sheet for hot pressing. The hot-rolled sheet may be acid-washed as needed, cold-rolled to a cold rolling reduction of 10% to 80%, and yield a cold-rolled sheet. The cold-rolled sheet may be used herein as intact as the steel sheet for hot pressing. Alternatively, the cold-rolled sheet may be softened by annealing in a continuous annealing line before use as the steel sheet for hot pressing. The hot-rolled sheet or cold-rolled sheet may be coated with a various coating in a continuous coating line to give a coated steel sheet before use as the steel sheet for hot pressing. The coating is exemplified by, but not limited to, zinc coating (galvanizing coating), hot-dip galvannealing coating, Zn—Al coating, Zn—Al—Mg coating, and hot-dip galvannealing Zn—Al—Mg coating.

Next, the hot pressed article according to the present invention will be illustrated. The hot pressed article according to the present invention has the same chemical composition as the steel sheet for hot pressing according to the present invention, includes martensite in an area percentage of 90% or higher of its entire microstructure, and includes nitride-basal inclusions with an equivalent circle diameter of 1 μm or more in a number density 0.1 less than 0.10 per square millimeter, as described above.

Among the factors, the chemical composition and the number density of nitride-based inclusions have been described in detail in the steel sheet for hot pressing and are not described herein.

The hot pressed article according to the present invention is adapted to include martensite in an area percentage of 90% or higher of the entire microstructure, so as to have a tensile strength typically of 1180 MPa or more. The martensite area percentage is preferably 95% or higher, and more preferably 100%. Other phases than martensite constituting the microstructure are exemplified by soft phases such as ferrite and bainite.

The area percentages of the individual phases may be measured by subjecting the steel sheet to LePera etching, identifying individual phases through observation with a transmission electron microscope (TEM) at 1500-fold magnification, and measuring the area percentages of the individual phases by observation with an optical microscope at 1000-fold magnification.

The hot pressed article according to the present invention is preferably manufactured in the following manner. Initially, the steel sheet for hot pressing according to the present invention is heated to a temperature of the Ac3 point to a temperature higher than the Ac3 point by_100 ° C. [from the Ac3 point to the Ac3 point+100° C.]. The heating, if performed to a temperature lower than the Ac3 point, may cause the hot pressed article to have an insufficient strength due to the formation of soft phases such as ferrite after quenching. In contrast, the heating, if performed to a temperature higher than the Ac3 point by higher than 100° C., may cause austenite grains to coarsen to thereby cause inferior ductility, The Ac3 point may be calculated according to an expression as follows:

$$Ac3\ (^\circ\ CC)=910-203\times[C]1/2+44.7\times[Si]-30\times[Mn]+700\times[P]+400\times[Al\ ]+400\times[Ti]+104\times[V]-11\times[Cr]+31.5\times[Mo]-20\times[Cu]-15.2\times[Ni] \quad (3)$$

Next, the heated steel sheet is hot-pressed with a tool. The article after hot pressing is quenched herein by cooling at an average cooling rate of 30° C./s or more, and preferably 40° C./s or more, particularly in the temperature range from 800° C. down to 300° C. This is performed so as to convert austenite obtained in the heating process into a microstructure mainly including martensite while suppressing the formation of ferrite and bainite.

The article is then cooled down to room temperature at an average cooling rate of about 1 to about 40° C./s. The hot pressed article according to the present invention may be obtained in this manner.

EXAMPLES

The present invention will be illustrated in further detail with reference to several examples below. It should be noted, however, that the examples are by no means intended to limit the scope of the invention; that various changes and modifications can naturally be made therein without deviating from the spirit and scope of the invention as described herein; and all such changes and modifications should be considered to be within the scope of the invention.

Ingot steels having chemical compositions given in Table 1 were made by vacuum melting. The ingot steels were formed into slabs having a thickness of 30 mm by die cooling at different average cooling rates as given in Table 2 in the temperature range from 1500° C. down to 1300° C. during casting. In this experimental example, the average cooling rates were 1.0° C./s (within the recommended condition in the present invention) and 0.2° C./s (out of the recommended condition). The slabs were heated to 1150° C., hot-rolled at a finish rolling temperature of 930° C. to a thickness of 2.8 mm, cooled at an average cooling rate of 30° C./s, and coiled at a temperature of 600° C. The works were acid-washed, cold-rolled, and yielded cold-rolled sheets having a thickness of 1.4 mm. In Table 1, the symbol "–" refers to that an element in question was not added.

Some of the prepared cold-rolled sheets were subjected to galvanizing coating (No. 7), galvannealing coating (No. 8), or annealing (heat treatment) at 700° C. for 2 hours (No. 10) as in Table 2 before use as sample steel sheets for hot pressing; and the others were used as sample steel sheets for hot pressing as intact as cold-rolled sheets.

The sample steel sheets were heated in a heating furnace at 930° C. in the atmosphere for 3 minutes. The heating temperature falls within the temperature range (Ac3 point to Ac3 point+100° C.) recommended in the present invention. After heating, the samples were sandwiched between flat tools and quenched at a controlled average cooling rate of 50° C./s in a temperature range from 800° C. down to 300° C. This process simulated a hot pressing treatment.

The samples after the hot pressing treatment were subjected to measurements of area percentages of individual phases, and size and number density of nitride-based inclusions by the measuring methods described above.

To evaluate mechanical properties, the samples after the hot pressing treatment were each subjected to a tensile test and a bend test as follows.

The tensile test was performed using a No. 5 test specimen prescribed in Japanese Industrial Standard (JIS) Z 2201 by the method prescribed in JIS Z 2241 to measure a tensile strength. A sample having a tensile strength of 1180 MPa or more was accepted herein. The tensile strength is preferably 1270 MPa or more, and more preferably 1470 MPa or more.

The bend test was performed according to the method prescribed in JIS Z 2248 using a No. 3 test specimen (30 mm wide by 60 mm long) by a pressing bend method (miler bend method) under conditions as follows. A stroke length of the loading pin at which the load reached maximum was defined as a performance index for bendability.

Supporting roller diameter: 30 mm

Loading pin bend radius r: 0.2 mm

Roller-to-roller distance L: 5.6 mm

A sample having a bendability (in terms of stroke length) of 8.0 mm or more was accepted in the experimental example. The bendability is preferably 9.0 mm or more.

To evaluate hardenability, upper critical cooling rates of the sample steel sheets before the hot pressing treatment were determined in a manner as follows. Specifically, the sample steel sheets were each held at 930° C. for 3 min and cooled at different cooling rates using the Formastor test equipment to determine an upper critical cooling rate, and this was defined as a performance index for hardenability. A sample having an upper critical cooling rate of 30° C./s or less was accepted in the experimental example. The upper critical cooling rate is preferably 25° C./s or less, and more preferably 20° C./s or less.

The results of the tests and evaluations are also indicated in Table 2. In the "microstructure" in Table 2, the symbols α, B, and M represent ferrite, bainite, and martensite, respectively. For reference, calculation results of the Al content determined according to the Si content are indicated in "Al content specified in the present invention"; and whether the contents meet the condition specified in the present invention are indicated in "Conformance" in Table 1. In the "Conformance", a sample indicated with "conforming" is one meeting the condition specified in the present invention; whereas a sample indicated with "unconforming" is one not meeting the condition specified in the present invention, where the condition relates to the Al content.

TABLE 1

| | Chemical composition (in mass percent, with the remainder being Fe and inevitable impurities | | | | | | | | | | | | |
|---|---|---|---|---|---|---|---|---|---|---|---|---|---|
| | | | | | | | Al content specified in the present invention | | | | | | |
| Steel | C | Si | Mn | P | S | Al | (0.20 + 2[N] − 0.40[Si]) to 0.3 at Si content of 0.5 or less | 2[N] to 0.3 at Si content of greater than 0.5 to 2.0 | Conformance | B | N | Ti | Other element |
| A | 0.23 | 0.20 | 1.21 | 0.009 | 0.0020 | 0.066 | 0.128 | — | unconforming | 0.0024 | 0.0042 | 0.0193 | — |
| B | 0.20 | 0.23 | 1.95 | 0.007 | 0.0008 | 0.057 | 0.117 | — | unconforming | 0.0017 | 0.0044 | 0.0012 | — |
| C | 0.21 | 1.09 | 1.12 | 0.010 | 0.0016 | 0.066 | — | 0.006 | conforming | 0.0024 | 0.0031 | 0.0009 | — |
| D | 0.24 | 1.28 | 1.64 | 0.005 | 0.0006 | 0.061 | — | 0.008 | conforming | 0.0018 | 0.0042 | 0.0007 | — |
| E | 0.21 | 1.14 | 1.13 | 0.009 | 0.0008 | 0.074 | — | 0.007 | conforming | 0.0020 | 0.0034 | 0.0014 | — |
| F | 0.23 | 1.17 | 0.80 | 0.009 | 0.0005 | 0.061 | — | 0.007 | conforming | 0.0026 | 0.0034 | 0.0012 | — |
| G | 0.21 | 0.67 | 1.32 | 0.009 | 0.0011 | 0.045 | — | 0.007 | conforming | 0.0022 | 0.0037 | 0.0013 | — |
| H | 0.22 | 1.08 | 1.02 | 0.010 | 0.0016 | 0.062 | — | 0.006 | conforming | 0.0025 | 0.0031 | 0.0006 | — |
| I | 0.22 | 1.19 | 0.93 | 0.008 | 0.0013 | 0.090 | — | 0.009 | conforming | 0.0027 | 0.0043 | 0.0006 | Cr: 0.20 |
| J | 0.23 | 1.15 | 1.76 | 0.008 | 0.0008 | 0.089 | — | 0.007 | conforming | 0.0022 | 0.0035 | 0.0011 | Mo: 0.08 |
| K | 0.22 | 1.22 | 1.95 | 0.007 | 0.0010 | 0.056 | — | 0.008 | conforming | 0.0023 | 0.0039 | 0.0011 | Zr: 0.02 |
| L | 0.21 | 1.26 | 1.09 | 0.007 | 0.0007 | 0.041 | — | 0.008 | conforming | 0.0020 | 0.0039 | 0.0005 | Cu: 0.12 |
| M | 0.21 | 1.20 | 1.29 | 0.008 | 0.0015 | 0.058 | — | 0.009 | conforming | 0.0016 | 0.0044 | 0.0013 | Ni: 0.21 |
| N | 0.24 | 1.18 | 1.46 | 0.005 | 0.0011 | 0.088 | — | 0.007 | conforming | 0.0026 | 0.0035 | 0.0011 | V: 0.15 |
| O | 0.20 | 1.01 | 1.15 | 0.005 | 0.0013 | 0.066 | — | 0.008 | conforming | 0.0016 | 0.0040 | 0.0014 | Nb: 0.06 |
| P | 0.22 | 1.28 | 1.56 | 0.005 | 0.0015 | 0.084 | — | 0.009 | conforming | 0.0023 | 0.0044 | 0.0014 | Cr: 0.14 |
| Q | 0.21 | 1.23 | 1.73 | 0.010 | 0.0008 | 0.043 | — | 0.009 | conforming | 0.0019 | 0.0044 | 0.0013 | Cr: 0.41 |
| R | 0.12 | 1.23 | 1.62 | 0.007 | 0.0013 | 0.040 | — | 0.008 | conforming | 0.0028 | 0.0038 | 0.0006 | Cr: 0.21 |
| S | 0.31 | 1.27 | 1.99 | 0.008 | 0.0005 | 0.041 | — | 0.007 | conforming | 0.0029 | 0.0035 | 0.0015 | Cr: 0.23 |
| T | 0.23 | 1.00 | 0.30 | 0.008 | 0.0011 | 0.041 | — | 0.007 | conforming | 0.0018 | 0.0037 | 0.0008 | Cr: 0.20 |
| U | 0.21 | 1.24 | 1.72 | 0.021 | 0.0008 | 0.053 | — | 0.006 | conforming | 0.0019 | 0.0031 | 0.0010 | — |
| V | 0.22 | 0.18 | 1.26 | 0.010 | 0.0011 | 0.214 | 0.136 | | conforming | 0.0020 | 0.0040 | 0.0052 | Cr: 0.15 |

TABLE 2

| | | | | Hot pressing conditions | | | | | | | |
|---|---|---|---|---|---|---|---|---|---|---|---|
| Test sample number | Steel | Cooling rate in casting (° C./s) | Treatment after cold rolling | Heating temperature (° C.) | Average cooling rate (° C./s) | Micro-structure (area percentage) | Number density (number per square millimeter) of nitride-based inclusions of 1 μm or more | Tensile strength (MPa) | Bendability (mm) | Hardenability Upper critical cooling rate (° C./s) | Remarks |
| 1 | A | 0.2 | — | 930 | 50 | M: 100 | 0.720 | 1520 | 7.2 | 15 | Com. Ex. |
| 2 | A | 1.0 | — | 930 | 50 | M: 100 | 0.490 | 1520 | 7.4 | 15 | Com. Ex. |
| 3 | B | 0.2 | — | 930 | 50 | α: 5<br>B: 20<br>M: 75 | 0.120 | 1230 | 7.2 | 35 | Com. Ex. |

TABLE 2-continued

| Test sample number | Steel | Cooling rate in casting (° C./s) | Treatment after cold rolling | Hot pressing conditions: Heating temperature (° C.) | Hot pressing conditions: Average cooling rate (° C./s) | Hot pressing conditions: Micro-structure (area percentage) | Number density (number per square millimeter) of nitride-based inclusions of 1 μm or more | Tensile strength (MPa) | Bendability (mm) | Hardenability Upper critical cooling rate (° C./s) | Remarks |
|---|---|---|---|---|---|---|---|---|---|---|---|
| 4 | C | 0.2 | — | 930 | 50 | M: 100 | 0.110 | 1564 | 7.6 | 25 | Com. Ex. |
| 5 | C | 1.0 | — | 930 | 50 | M: 100 | 0.021 | 1548 | 9.6 | 25 | Example |
| 6 | D | 1.0 | — | 930 | 50 | M: 100 | 0.013 | 1500 | 9.1 | 20 | Example |
| 7 | E | 1.0 | Galvanizing | 930 | 50 | M: 100 | 0.016 | 1595 | 9.5 | 25 | Example |
| 8 | F | 1.0 | Galvannealing | 930 | 50 | M: 100 | 0.032 | 1572 | 9.3 | 25 | Example |
| 9 | G | 1.0 | — | 930 | 50 | M: 100 | 0.024 | 1518 | 8.4 | 20 | Example |
| 10 | H | 1.0 | Annealing at 700° C. for 2 h | 930 | 50 | M: 100 | 0.024 | 1530 | 9.0 | 25 | Example |
| 11 | I | 1.0 | — | 930 | 50 | M: 100 | 0.027 | 1512 | 9.4 | 25 | Example |
| 12 | J | 1.0 | — | 930 | 50 | M: 100 | 0.021 | 1598 | 9.2 | 20 | Example |
| 13 | K | 1.0 | — | 930 | 50 | M: 100 | 0.490 | 1516 | 7.4 | 20 | Com. Ex. |
| 14 | L | 1.0 | — | 930 | 50 | M: 100 | 0.016 | 1567 | 9.1 | 25 | Example |
| 15 | M | 1.0 | — | 930 | 50 | M: 100 | 0.024 | 1529 | 9.0 | 20 | Example |
| 16 | N | 1.0 | — | 930 | 50 | M: 100 | 0.037 | 1557 | 9.7 | 20 | Example |
| 17 | O | 1.0 | — | 930 | 50 | M: 100 | 0.016 | 1516 | 9.2 | 25 | Example |
| 18 | P | 1.0 | — | 930 | 50 | M: 100 | 0.035 | 1515 | 9.1 | 20 | Example |
| 19 | Q | 1.0 | — | 930 | 50 | α: 5<br>M: 95 | 0.035 | 1596 | 9.3 | 25 | Example |
| 20 | R | 1.0 | — | 930 | 50 | M: 100 | 0.037 | 1211 | 9.0 | 20 | Example |
| 21 | S | 1.0 | — | 930 | 50 | M: 100 | 0.035 | 1832 | 9.4 | 15 | Example |
| 22 | T | 1.0 | — | 930 | 50 | α: 20<br>B: 60<br>M: 20 | 0.013 | 1547 | 9.2 | 60 | Com. Ex. |
| 23 | U | 1.0 | — | 930 | 50 | M: 100 | 0.035 | 1555 | 7.6 | 20 | Com. Ex. |
| 24 | V | 1.0 | — | 930 | 50 | M: 100 | 0.045 | 1512 | 9.2 | 20 | Example |

Test Nos. 5 to 12, 14 to 21, and 24 in Table 2 were samples prepared by preparing Steels C to J, L to S, and V having chemical compositions meeting the conditions in the present invention (see Table 1); manufacturing steel sheets for hot pressing from the steels under preferred conditions in the present invention, including the average cooling rate during casting (see Table 2); and subjecting the steel sheets to a hot pressing treatment. The resulting sample steel sheets after the hot pressing treatment met acceptance criteria all in tensile strength, bendability, and upper critical cooling rate as an index for hardenability.

In contrast, Test Nos. 1 to 4, 13, 22, and 23 in Table 2 were samples prepared under conditions, at least one of which did not meet the condition(s) specified in the present invention. The samples fail to meet the acceptance criteria in at least one of tensile strength, bendability, and hardenability.

Test No. 1 in Table 2 was a sample prepared by manufacturing a steel sheet for hot pressing from Steel A in Table 1 through casting at an excessively low average cooling rate. Steel A had an Al content not meeting the condition specified in the present invention in relation to the Si content and had an excessively high Ti content. The resulting sample included coarse nitride-based inclusions in a large number density and offered inferior bendability.

Test No. 2 in Table 2 was a sample prepared by manufacturing a steel sheet for hot pressing from Steel A not meeting the condition specified in the present invention as with Test No. 1, but through casting at an average cooling rate within the preferred range in the present invention. The resulting sample included coarse nitride-based inclusions in a large number density due to the low Al content and offered inferior bendability.

Test No. 3 in Table 2 was a sample prepared from Steel B in Table 1 through casting at an excessively low average cooling rate. Steel B had a low Al content not meeting the condition specified in the present invention in relation to the Si content. The resulting sample included coarse nitride-based inclusions in a large number density and offered inferior bendability. In addition, the sample included martensite in a low area percentage and offered inferior hardenability. This is because, when a sample has an excessively low Al content in relation to the Si content and is adapted to have a Ti content controlled to 0.005% or lower as with Test No. 3, boron forms boron nitride (BN) during heating and loses its hardenability improving effect.

Test No. 4 in Table 2 was a sample prepared from Steel C in Table 1 meeting the conditions specified in the present invention, but through casting at an excessively low average cooling rate. The resulting sample included coarse nitride-based inclusions in a large number density and offered inferior bendability.

Test No. 13 in Table 2 was a sample prepared from Steel K in Table 1 having a high Zr content. The resulting sample included coarse nitride-based inclusions in a large number density and offered inferior bendability.

Test No. 22 in Table 2 was a sample prepared from Steel T in Table 1 having a low Mn content. The resulting sample included martensite in a low area percentage and also offered inferior hardenability.

Test No. 23 in Table 2 was a sample prepared from Steel U in Table 1 having a high phosphorus content. The resulting sample offered inferior bendability.

The present invention has been described in detail and with reference to specific embodiments thereof, it is susceptible to various changes and modifications without departing from the spirit and scope of the present invention will be apparent to those skilled in the art. This application is based on Japanese patent application filed on Dec. 10, 2014 (Japanese Patent Application No. 2014-250055), the contents of which are incorporated herein by reference.

INDUSTRIAL APPLICABILITY

The steel sheet for hot pressing according to the present invention has improved bendability after processing, and is useful for the body of an automobile.

The invention claimed is:

1. A hot pressed article formed of a steel sheet comprising, in a chemical composition:

C in a content of 0.1% to 0.4%;

Si in a content of 0% to 2.0%;

Mn in a content of 0.5% to 3.0%;

P in a content of greater than 0% to 0.015%;

S in a content of greater than 0% to 0.01%;

B in a content of 0.0003% to 0.01%;

N in a content of greater than 0% to 0.05%;

Al in a content of 2×[N]% to 0.3% at a Si content of greater than 0.5% to 2.0%; or Al in a content of (0.20+2×[N]−0.40×[Si])% to 0.3% at a Si content of 0% to 0.5%, where [N] and [Si] are contents of N and Si, respectively, in mass percent;

at least one element selected from the group consisting of:

V in a content of greater than 0% to 0.2%, and

Nb in content of greater than 0% to 0.2%;

with the remainder being iron and inevitable impurities, the steel sheet having contents of Ti, Zr, Hf, and Ta, of the inevitable impurities, controlled to 0.003% or lower; and the steel sheet comprising nitride-based inclusions with an equivalent circle diameter of 1 μm or more in a number density of less than 0.10 per square millimeter;

the steel sheet comprising nitride-based inclusions with an equivalent circle diameter of less than 1 μm in a number density of about 2 to about 100 per square millimeter;

the hot pressed article comprising martensite in an area percentage of 90% or higher of an entire microstructure thereof; and the hot pressed article having a number density of nitride-based inclusions with an equivalent circle diameter of 1 μm or more of less than 0.10 per square millimeter.

* * * * *